US009581121B2

(12) United States Patent
Ryon et al.

(10) Patent No.: US 9,581,121 B2
(45) Date of Patent: Feb. 28, 2017

(54) RETENTION FEATURE FOR FUEL INJECTOR NOZZLE

(71) Applicant: Delavan Inc., Des Moines, IA (US)

(72) Inventors: Jason Ryon, Carlisle, IA (US); Mark Caples, Ankeny, IA (US); John David Canny, Indianola, IA (US); Nicole L. Nelson, Des Moines, IA (US)

(73) Assignee: Delavan Inc., Des Moines, IA (US)

( * ) Notice: Subject to any disclaimer, the term of this patent is extended or adjusted under 35 U.S.C. 154(b) by 135 days.

(21) Appl. No.: 14/523,587

(22) Filed: Oct. 24, 2014

(65) Prior Publication Data

US 2016/0115926 A1 Apr. 28, 2016

(51) Int. Cl.

| | |
|---|---|
| ***F02M 61/18*** | (2006.01) |
| ***F23D 11/24*** | (2006.01) |
| ***F23D 11/38*** | (2006.01) |
| ***F02M 61/16*** | (2006.01) |

(52) U.S. Cl.

CPC ..... *F02M 61/1813* (2013.01); *F02M 61/162* (2013.01); *F02M 61/168* (2013.01); *F23D 11/24* (2013.01); *F23D 11/383* (2013.01); *F23D 2900/11101* (2013.01); *F23N 2035/28* (2013.01)

(58) Field of Classification Search

CPC . F02M 61/1813; F02M 61/162; F02M 61/168

USPC ..... 60/746, 776, 748, 749, 750, 747, 743; 285/321, 376

See application file for complete search history.

(56) References Cited

U.S. PATENT DOCUMENTS

| | | | | |
|---|---|---|---|---|
| 6,321,541 | B1 * | 11/2001 | Wrubel | G11C 7/222 60/740 |
| 6,733,046 | B1 * | 5/2004 | Rief | E04H 4/1654 285/276 |
| 8,033,113 | B2 | 10/2011 | Patel et al. | |
| 8,156,746 | B2 | 4/2012 | Buelow et al. | |
| 8,196,845 | B2 | 6/2012 | Thomson et al. | |
| 8,636,263 | B2 | 1/2014 | Deaton et al. | |
| 8,734,071 | B2 | 5/2014 | Babej | |
| 2002/0134084 | A1 * | 9/2002 | Mansour | F23D 11/107 60/740 |

(Continued)

FOREIGN PATENT DOCUMENTS

EP 2413037 A2 2/2012

OTHER PUBLICATIONS

Extended European Search Report, for European Patent Application No. 15191236.7, dated Feb. 25, 2016, 8 pages.

*Primary Examiner* — Arthur O Hall
*Assistant Examiner* — Viet Le
(74) *Attorney, Agent, or Firm* — Kinney & Lange, P.A.

(57) ABSTRACT

A nozzle for a fuel injector can include an outer air swirler having an inner surface with the outer air swirler having a groove on the inner surface and a prefilmer located concentrically within the outer air swirler with the prefilmer having at least one detent finger to engage the groove on the inner surface of the outer air swirler. The nozzle can also include a fuel swirler located concentrically within the prefilmer and configured to convey fuel to a forward end of the nozzle with the fuel swirler having at least one tab extending axially at an aft end, and an inner air swirler having a cylindrical forward end located concentrically within the fuel swirler and an aft support extending radially outward to contact the outer air swirler with the cylindrical forward end contacting at least one tab of the fuel swirler to hold the fuel swirler in place.

20 Claims, 6 Drawing Sheets

(56) References Cited

U.S. PATENT DOCUMENTS

| | | | | |
|---|---|---|---|---|
| 2004/0139750 | A1* | 7/2004 | Bretz | F23D 11/107 60/776 |
| 2010/0107653 | A1 | 5/2010 | Paskevich et al. | |
| 2014/0123655 | A1 | 5/2014 | Cheung | |
| 2014/0157781 | A1 | 6/2014 | Moran et al. | |

* cited by examiner

RETENTION FEATURE FOR FUEL INJECTOR NOZZLE

BACKGROUND

The present disclosure relates to fuel injectors in a gas turbine engine and, more particularly, to the retention of components in a fuel injector nozzle.

A variety of devices and methods are known in the art for injecting fuel into gas turbine engines, many of which are directed to injecting fuel into combustors of gas turbine engines under high temperature conditions. Fuel injectors for gas turbine engines on an aircraft direct fuel from a manifold to a combustion chamber of a combustor. The fuel injector typically has an inlet fitting connected to the manifold for receiving the fuel, a fuel nozzle located within the combustor for spraying fuel into the combustion chamber, and a stem extending between and fluidly connecting the inlet fitting and the fuel nozzle. Fuel injectors are usually heat-shielded because of high operating temperatures arising from high temperature gas turbine compressor discharge air flowing around the stem and nozzle. The heat shielding helps prevent the fuel passing through the injector from coking, which can occur when the wetted wall temperatures of the fuel passage exceed a particular temperature. Coke in the fuel passages of the fuel injector can undesirably build up to restrict fuel flow to the nozzle and reduce the lifespan of the fuel injector.

A number of devices have been used to insulate the fuel passages in the nozzle from the relatively high temperatures outside the fuel nozzle, including the use of multiple annular stagnant air gaps between external walls (those in thermal contact with the relatively high temperatures outside the nozzle) and internal walls (those in thermal contact with the relatively cool temperatures of the fuel). Problems arise in fastening these walls together, for the fastener needs to be able to accommodate differing thermal expansion between the walls while holding the nozzle components together to prevent coking between the walls and wear due to vibration. Welds, braze, and/or pins are used, but welds and braze allow for direct conduction of heat between the external and internal walls, while pins provide additional wear surfaces that lead to damaging due to vibration. Additionally, welds, braze, and pins prevent the testing of the internal walls and other components within the external walls until the entire nozzle is constructed and make replacement of only one or a select number of internal components difficult because access to those components can only be achieved through the breaking of the welds and/or removal of the pins.

SUMMARY

Embodiments of the present disclosure include a fuel injector with a nozzle, the nozzle includes an outer air swirler having an outer surface and an inner surface and a forward end and an aft end with the outer air swirler having a groove on the inner surface, and a prefilmer located concentrically within the outer air swirler with the prefilmer having at least one detent finger to engage the groove on the inner surface of the outer air swirler. The nozzle can also include a fuel swirler located concentrically within the prefilmer and configured to convey fuel to a forward end of the nozzle with the fuel swirler having at least one tab extending axially at an aft end and an inner air swirler having a cylindrical forward end located concentrically within the fuel swirler and an aft support extending radially outward to contact the outer air swirler with the cylindrical forward end contacting the at least one tab of the fuel swirler to hold the fuel swirler in place.

Another embodiment of the present disclosure include a method of constructing a nozzle for a fuel injector, the method includes inserting a prefilmer with at least one detent finger into an outer air swirler with a groove on an inner surface and engaging the groove in the outer air swirler with the at least one detent finger. The method can also include inserting a fuel swirler into the prefilmer with the fuel swirler having at least one tab at an aft end that extends in an axial direction and engaging the at least one tab of the fuel swirler with a cylindrical forward end of an inner air swirler.

Figure 1:
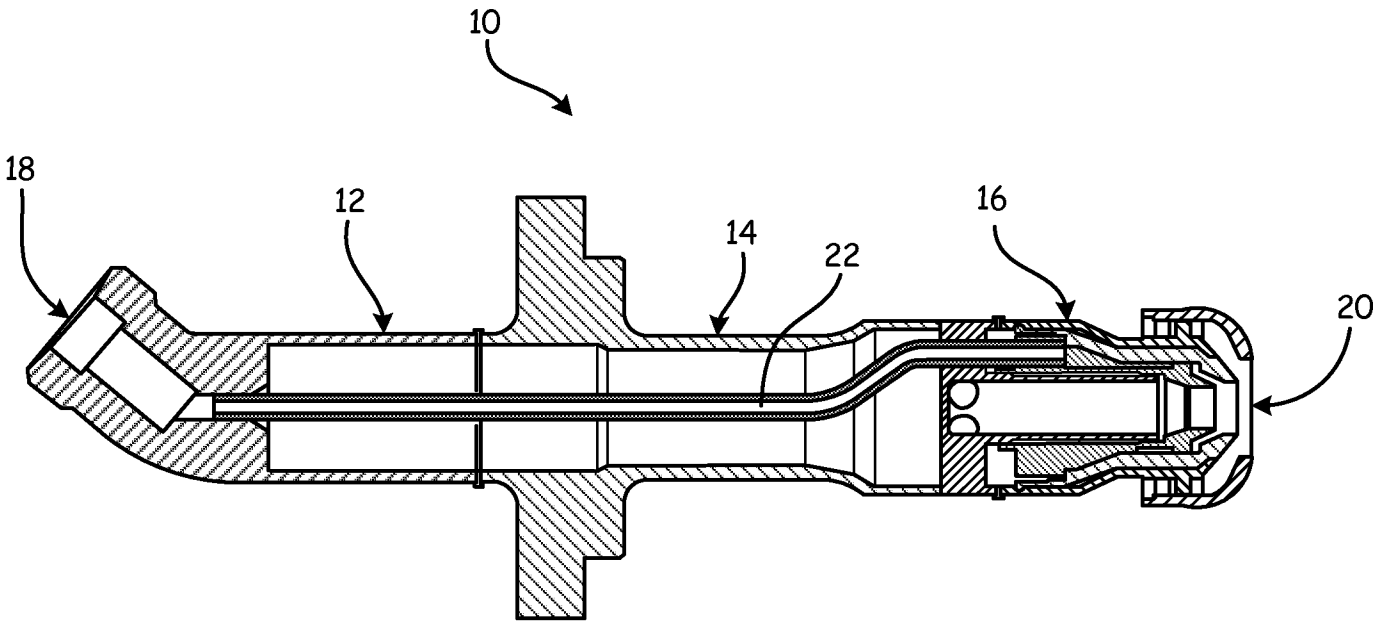
FIG. 1 is a cross-sectional view of a fuel injector.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

FIG. 1 is a cross-sectional view of a fuel injector. As shown in FIG. 1, fuel injector 10 includes feed arm 12, stem 14, and nozzle 16 fluidly connected between fuel inlet 18 and tip 20. Running substantially between fuel inlet 18 and tip 20 is fuel tube 22, which conveys fuel from a source (not shown) upstream of fuel inlet 18 to nozzle 16, where the fuel is then expelled by nozzle 16 near tip 20 into a combustion chamber (not shown). While FIG. 1 shows fuel injector 10 as substantially linear, fuel injector 10 can have other configurations, such as an L-shaped configuration.

Fuel injector 10 introduces fuel into the combustion chamber, where the fuel is combined with air and ignited or, in the configuration of FIG. 1, fuel injector 10 mixes fuel with air within nozzle 16 and then introduces the fuel-air mixture into the combustion chamber where it is ignited.

Figure 2:
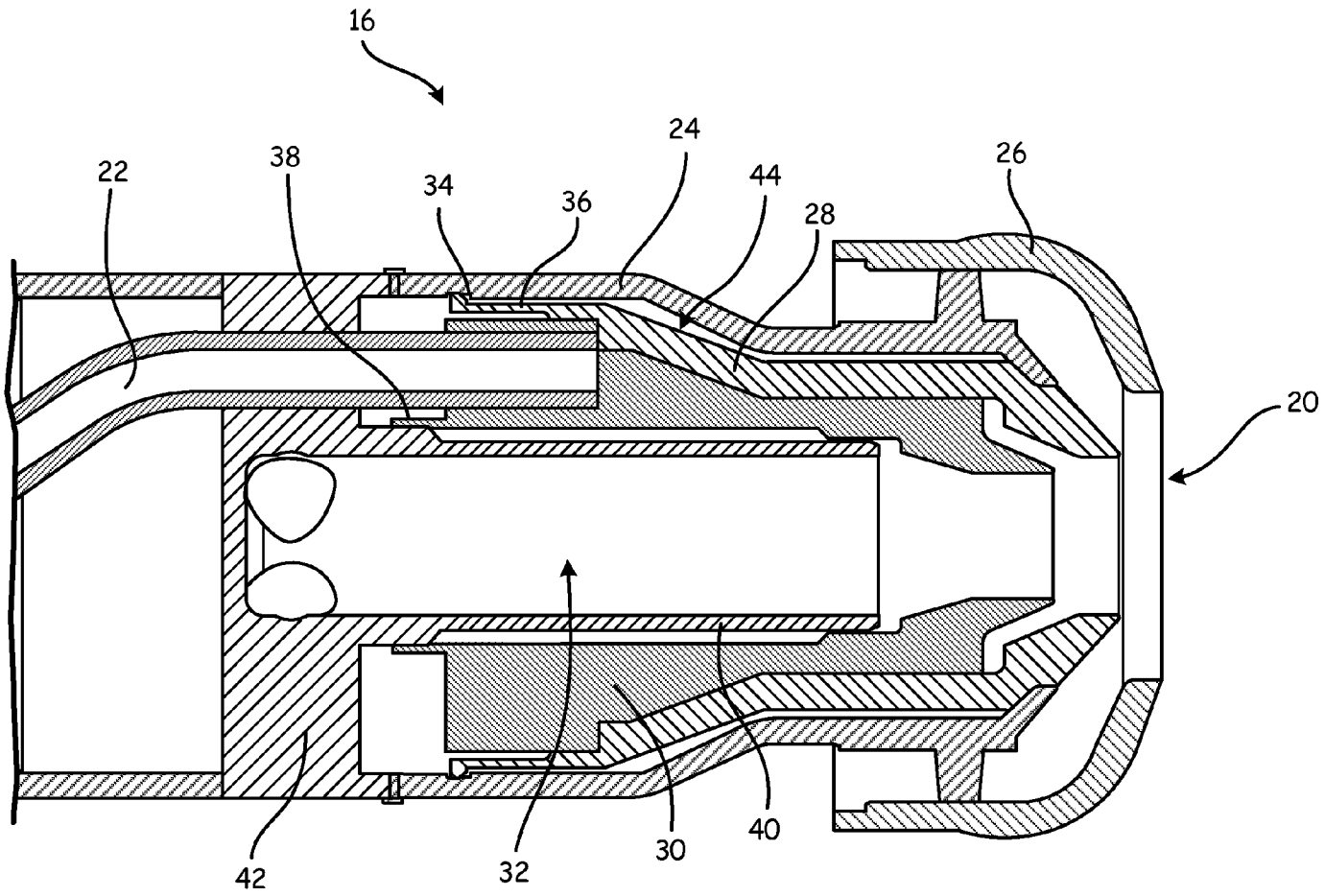
FIG. 2 is an enlarged cross-sectional view of a nozzle of the fuel injector of FIG. 1.
Figure 3:
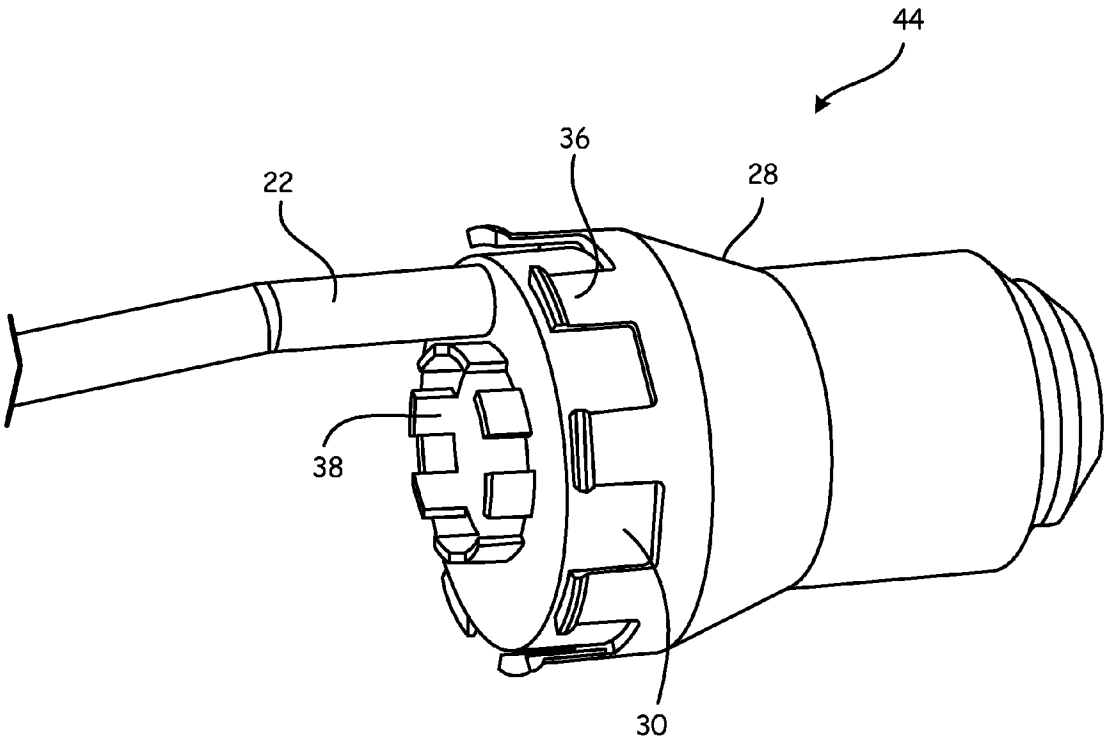
FIG. 3 is a perspective view of a metering set of the fuel injector nozzle in isolation.
Figure 4A:
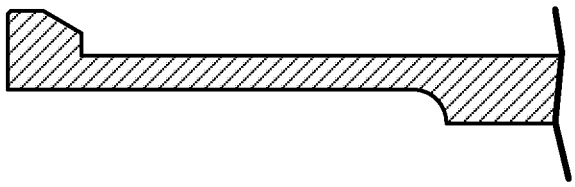
FIG. 4A is an enlarged cross-sectional view of one embodiment of a detent finger.
Figure 4B:
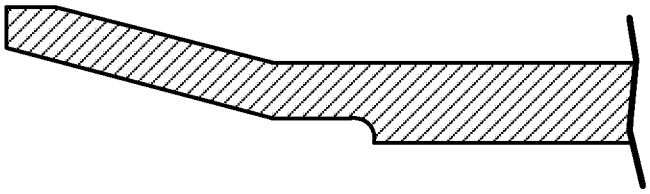
FIG. 4B is an enlarged cross-sectional view of another embodiment of a detent finger.
Figure 4C:
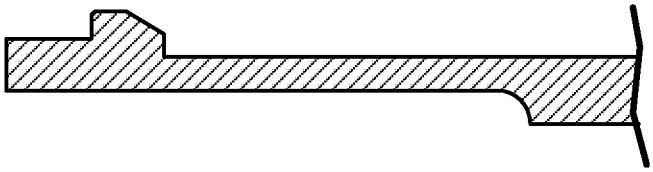
FIG. 4C is an enlarged cross-sectional view of a third embodiment of a detent finger.

Referring to FIGS. 2, 3, 4A, 4B, and 4C: FIG. 2 is an enlarged cross-sectional view of the nozzle of the fuel injector of FIG. 1, FIG. 3 is a perspective view of a metering set of the fuel injector nozzle in isolation, and FIGS. 4A-4C are enlarged cross-sectional views of various embodiments of a detent finger. Nozzle 16 of FIGS. 2 and 3 can be categorized as an airblast style fuel injector, but the present disclosure is not limited to such a configuration.

Nozzle 16 includes a downstream portion of fuel tube 22, outer air swirler 24, air cap 26 at tip 20, prefilmer 28, fuel swirler 30, and inner air swirler/inner heat shield 32. Outer air swirler 24 includes groove 34 on an inner surface, while prefilmer 28 includes detent fingers 36. Fuel swirler 30 includes tabs 38, and inner heat shield (synonymously referred to herein as inner air swirler) 32 includes front cylinder 40 and rear disk 42. Metering set 44 is used to designate the inner fuel metering components of nozzle 16, including prefilmer 28, fuel swirler 30, and a downstream portion of fuel tube 22.

Outer air swirler 24 forms the outer wall of nozzle 16 and is in direct contact with relatively high temperature air that flows from the compressor into the combustion chamber. The relatively high temperature air flows through nozzle 16 through outer air swirler 24 or inner air swirler/inner heat shield 32 and out through tip 20, where the relatively high temperature air is combined with fuel and ignited in the combustion chamber. Attached to the outer surface of outer air swirler 24 and towards tip 20 is air cap 26, which works in conjunction with outer air swirler 24 to mix the fuel with air at tip 20. Air cap 26 may be positioned such that air cap 26 is at least partially within the combustion chamber and is in contact with the relatively high temperature ignited fuel-air mixture. Air cap 26 can be connected to outer air swirler 24 by a variety of suitable means, including welding or brazing. The connection between outer air swirler 24, air cap 26, and other components of nozzle 16 should allow for thermal expansion. Outer air swirler 24 and air cap 26 can be made from a variety of materials, such as a metallic material or alloy, but should be able to handle the relatively high temperatures of the air within the compressor and the combustion chamber while minimizing the conduction of thermal energy into the inner components of nozzle 16 through outer air swirler 24. Outer air swirler 24 is shown in FIG. 2 as a quasi-cylindrical component that decreases in diameter closer to tip 20, but can have other configurations as needed.

On the inner surface of outer air swirler 24 is groove 34, which is shown in FIG. 2 to be located near stem 14 but can be located anywhere along the inner surface of outer air swirler 24. Groove 34 forms an indent in outer air swirler 24 into which detent fingers 36 can snap to hold the inner components (also called metering set 44) of nozzle 16 in place relative to outer air swirler 24 (will be described in detail later). Groove 34 can extend entirely around the inner surface of air swirler 24 or can be configured to be a series of grooves outward only from detent fingers 36. Additionally, the shape of the indent of groove 34 can be configured to resemble the shape of detent fingers 36 to hold detent fingers 36 tightly in place.

Located concentrically within outer air swirler 24 is metering set 44 (shown in FIG. 3), which includes prefilmer 28, fuel swirler 30, and a downstream portion of fuel tube 22. The components of metering set 44 function to control the introduction of fuel into nozzle 16 (and eventually, the combustion chamber). Immediately within outer air swirler 24 is prefilmer 28, which is shown in FIGS. 2 and 3 as a quasi-cylindrical component that decreases in diameter closer to tip 20 and has a smaller diameter than outer air swirler 24 at each corresponding location with respect to tip 20. Between outer air swirler 24 and prefilmer 28 can be a gap that includes air or another gas to aid in minimizing thermal conduction between outer air swirler 24 and prefilmer 28. As with outer air swirler 24, prefilmer 28 can have other configurations as needed. Prefilmer 28 can be made from a variety of materials, such as a metallic material or alloy, but should be resilient enough to allow for detent fingers 36 to snap into groove 34 while minimizing the conduction of thermal energy from outer air swirler 24 to fuel swirler 30.

Figure 5:
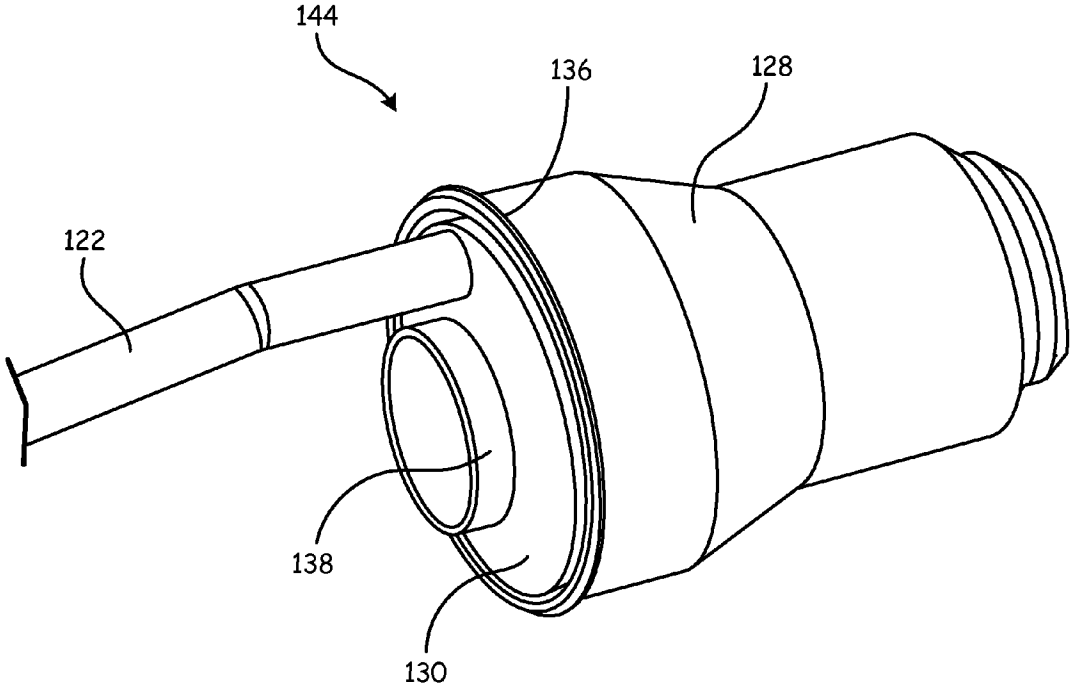
FIG. 5 is a perspective view of another embodiment of a metering set.

Prefilmer 28 includes detent fingers 36, which are pawls or similar components configured to retain prefilmer 28 in place concentrically within outer air swirler 24. Detent fingers 36 can be a number of detents spaced circumferentially around prefilmer 28, as shown in FIG. 3 as eight detents spaced equally around prefilmer 28, or can extend circumferentially around prefilmer 28 continuously to form a cylinder (as shown in FIG. 5 and will be discussed later). Detent fingers 36 are shown in FIG. 2 to be located near stem 14, but can be located anywhere along the outer surface of prefilmer 28 so long as detent fingers 36 are able to snap into groove 34 such that prefilmer 28 is held in place relative to outer air swirler 24.

Detent fingers 36 can have a number of shapes, such as those shown in FIGS. 4A, 4B, and 4C, or other shapes configured to snap into groove 34 and maintain concentricity. FIG. 4A shows a detent finger that is an angled block-like configuration at a distal position. FIG. 4B shows a detent finger that angles outward as the finger extends towards a distal end. FIG. 4C shows a detent finger that is an angled block-like configuration with the outward extending member in an axially intermediate position (i.e., not at a distal position). Additionally, detent fingers 36 can have other configurations, such as one that includes multiple outward extending fingers (with multiple grooves in outer air swirler 24) or a configuration that includes a triangular shape. The placement and shape of groove 34 and detent fingers 36 should allow for differing thermal expansions of prefilmer 28 and outer air swirler 24 while ensuring that the two components are held together.

The interaction between groove 34 and detent fingers 36 is only by interface contact with no other fastening means, thereby minimizing thermal conduction between outer air swirler 24 and prefilmer 28 as compared to welds, braze, or pins, which have increased thermal conduction because the welds, braze, or pins create a direct conduction path through which thermal energy can pass by having a fastening material between the two components (instead of the indirect interface contact conduction path of the disclosed configuration).

Additionally, because detent fingers 36 snap (e.g., simultaneously) into groove 34 to retain metering set 44 within outer air swirler 24 when prefilmer 28 is inserted into outer air swirler 24 so detent fingers 36 are inward of groove 34, there is no need to drill through outer air swirler 24 during assembly so a pin or other fastener can be installed to hold prefilmer 28 in place. Because a pin or other fastener is not needed, the number of components that can cause wear due to vibration of nozzle 16 is reduced. There is also no need to weld or braze the inner surface of outer air swirler 24 to prefilmer 28, which can be burdensome and time consuming during the assembly and quality inspection processes. In addition, because a weld, braze, or pin is not needed, there is one less connection that requires validation and possible rework if nozzle 16 (more particularly, the interface between outer air swirler 24 and prefilmer 28) is unsatisfactory. Thus, the use of groove 34 and detent fingers 36 reduces the number of parts required and the overall complexity of nozzle 16 (which, in turn, reduces cost).

Located concentrically within prefilmer 28 are fuel swirler 30 and a downstream portion of fuel tube 22, which work together to convey fuel through nozzle 16 to tip 20. Fuel tube 22 conveys fuel from fuel inlet 18 to fuel swirler 30 of nozzle 16, where fuel tube 22 ends and the fuel flows through fuel swirler 30 until the fuel is expelled near tip 20. Fuel swirler 30 is shown in FIGS. 2 and 3 as a quasi-cylindrical component that decreases in diameter closer to tip 20 and has a smaller diameter than prefilmer 28 at each corresponding location with respect to tip 20. Fuel swirler 30 can have spaces or gaps, or another configuration, to allow fuel to flow through fuel swirler 30 to tip 20. Fuel swirler 30 can be made from a variety of materials, such as a metallic material or alloy, but should be able to handle the relatively cool temperature of the fuel and any thermal energy passing to fuel swirler 30 through prefilmer 28 and inner air swirler/inner heat shield 32 without causing the fuel within fuel swirler 30 to coke.

Fuel swirler 30 includes tabs 38, which are extensions configured to hold fuel swirler 30 in place concentrically around inner air swirler/inner heat shield 32 and ensure that fuel swirler 30 stays in place relative to the other components of nozzle 16. Tabs 38 can extend circumferentially around fuel swirler 30 continuously to form a cylinder (as shown in FIG. 5 and will be discussed later), or can be a number of extensions spaced circumferentially around fuel swirler 30, as shown in FIG. 3.

Located substantially concentrically within fuel swirler 30 is inner air swirler/inner heat shield 32, which includes front cylinder 40 and rear disk 42. Inner air swirler/inner heat shield 32 is configured to allow air to flow through rear disk 42 and front cylinder 40 towards tip 20, where the air mixes with the fuel from fuel swirler 30. Because this air is at a relatively high temperature, inner air swirler/inner heat shield 32 should be able to shield fuel swirler 30 (and the fuel) from the high temperatures so as to reduce coking. Other designs could include a configuration where the inner air swirler and heat shield are two different components, but in nozzle 16 inner air swirler/inner heat shield 32 is one component. Between fuel swirler 30 and inner air swirler/inner heat shield 32 can be a gap that allows for air or another fluid to insulate fuel swirler 30 from inner air swirler/inner heat shield 32. Front cylinder 40 of inner air swirler/inner heat shield 32 is retained by fuel swirler 30 and, most notably, by tabs 38 of fuel swirler 30, which contact front cylinder 40 close to the region where front cylinder 40 is connected to rear disk 42. Front cylinder 40 can have a straight tubular configuration with helical vanes inside or another configuration that functions to swirl air before the air reaches tip 20 where the air combines with fuel from fuel swirler 30. Rear disk 42 is connected to one end of front cylinder 40 and is not located concentrically within fuel swirler 30, but rather extends outward to connect to a rear end of outer air swirler 24 to hold metering set 44 (prefilmer 28 and fuel swirler 30) in place. Rear disk 42 can include at least one channel to allow for the passage of air outside of nozzle 16 to front cylinder 40. The channel can be arranged so as to swirl the air as it enters front cylinder 40. Rear disk 42 can be fastened to outer air swirler 24 to contain metering set 44 of nozzle 16 within outer air swirler 24 and rear disk 42. Rear disk 42 can be fastened to outer air swirler 24 through various means, including welding or brazing. As shown in FIG. 2, rear disk 42 has an opening through which fuel tube 22 runs to reach fuel swirler 30. Inner air swirler/inner heat shield 32 can be made from a variety of materials, such as a metallic material or alloy, but should be able to handle the relatively high temperatures of the compressor discharge air and combustion air while minimizing the conduction of thermal energy.

As mentioned above, the disclosed invention is advantageous because the reduced need for welds, braze, or pins minimizes the chances that the components of nozzle 16 will be damaged due to wear, resulting in a longer lifespan of nozzle 16. Additionally, thermal conduction is lowered because there is only interface contact between the components of nozzle 16 (most notably outer air swirler 24 and prefilmer 28 due to the use of groove 34 and detent fingers 36) as opposed to direct conduction through a pin, braze, or weld. The use of detent fingers 36 and groove 34 also reduced thermal conduction because the total surface area of contact between outer air swirler 24 and prefilmer 28 is reduced. Further, assembly of nozzle 16 is easier and quicker because there is no need to weld, braze, or pin the components of metering set 44 to each other or to outer air swirler 24 except for the fastening of rear disk 42 of inner air swirler/inner heat shield 32 to outer air swirler 24, which is less burdensome because the connection is at the outer surface of nozzle 16. Because the components of metering 44 set are not welding, brazed, or pinned together, disassembly of nozzle 16 for maintenance is also easier and quicker (one would only have to break the connection between outer air swirler 24 and rear disk 42), and one component of nozzle 16 can be replaced or repaired without having to disturb other components (such as outer air swirler 24, prefilmer 28, fuel swirler 30, and inner air swirler/inner heat shield 32). Finally, the use of groove 34 with detent fingers 36, along with tabs 38, to maintain concentricity and retention of metering set 44 within outer air swirler 24 allows for greater flexibility in processing steps, thereby reducing time and cost.

FIG. 5 is a perspective view of another embodiment of a metering set. Metering set 144 includes a downstream portion of fuel tube 122, prefilmer 128 with annular detent 136, and fuel swirler 130 with extension 138.

Metering set 144 of FIG. 5 is similar to metering set 44 of FIGS. 2 and 3. Metering set 144 includes annular detent 136 of prefilmer 128 that extends circumferentially around prefilmer 128 continuously to form a cylinder. Other embodiments of the present invention could include various configurations of annular detent 136, including an extending member of annular detent 136 that is not rectangular (as in FIGS. 2 and 3), but rather is trapezoidal or another shape.

Metering set 144 also includes extension 138 of fuel swirler 130 that extends circumferentially to form a cylinder near a rear end of fuel swirler 130. Extension 138 is configured to contact an inner air swirler/inner heat shield (not shown) so as to hold fuel swirler 138 in place and maintain concentricity. Other embodiments of the present invention could include various configurations of the tabs, including tabs that are not rectangular (as in FIGS. 2 and 3), but rather are trapezoidal or another shape.

Figure 6:
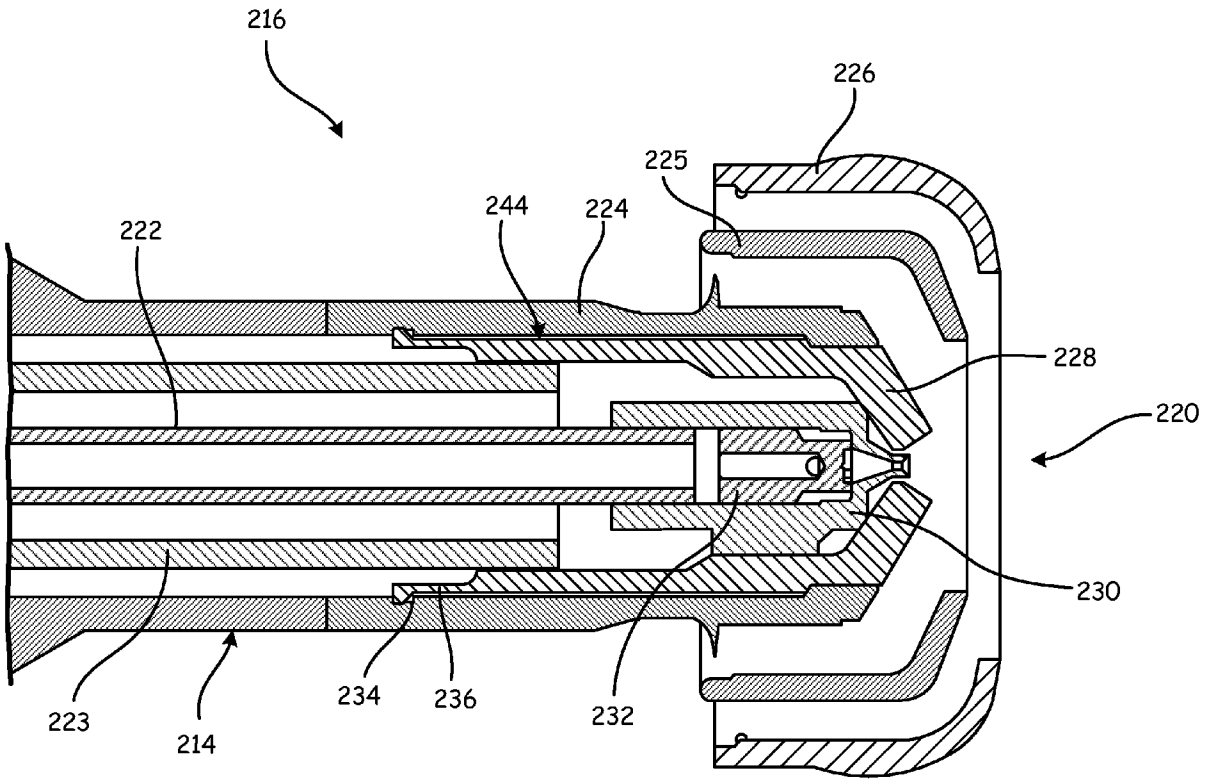
FIG. 6 is an enlarged cross-sectional view of another embodiment of a fuel injector nozzle having a pressure atomizer configuration.

FIG. 6 is an enlarged cross-sectional view of another embodiment of a fuel injector nozzle having a pressure atomizer configuration. Nozzle 216 includes a downstream portion of primary fuel tube 222 and a downstream portion of secondary fuel tube 223, both of which enter nozzle 216 from stem 214. Nozzle 216 further includes first outer air swirler 224, second outer air swirler 225, air cap 226 at tip 220, secondary cone (also called a prefilmer) 228, primary cone/secondary distributor 230, and primary distributor 232. First outer air swirler 224 includes groove 234 on an inner surface, while secondary cone 228 includes one or more detent fingers 236. The materials used and functionality of nozzle 216 is similar to that of nozzle 16 in FIGS. 1, 2, and 3.

First outer air swirler 224 forms the outer wall of nozzle 216 and is in direct contact with relatively high temperature air that flows from the compressor into the combustion chamber. The relatively high temperature air flows through nozzle 216 through first outer air swirler 224 and second outer air swirler 225 and out through tip 220, where the relatively high temperature air is combined with fuel and ignited in the combustion chamber. Attached to the outer surface of first outer air swirler 224 and towards tip 220 is second outer air swirler 225 and air cap 226, which work in conjunction with first outer air swirler 224 to mix the air with fuel before the mixture flows out tip 220. The downstream portion of nozzle 216, including the outer air cap 226, is subjected to relatively extremely hot temperatures due to recirculating hot products from the combustor, as well as flame radiation. Second outer air swirler 225 and air cap 226 can be connected to one another and to first outer air swirler 224 by a variety of suitable means, including welding or brazing. The connection between first outer air swirler 224, second outer air swirler 225, air cap 226, and other components of nozzle 216 should allow for thermal expansion. First outer air swirler 224, second outer air swirler 225, and air cap 226 can be made from a variety of materials, such as a metallic material or alloy, but should be able to handle the relatively high temperatures of the air being discharged from the compressor as well as the temperatures within the combustion chamber while minimizing the conduction of thermal energy into the inner components of nozzle 216 (also called metering set 244) through first outer air swirler 224. In FIG. 6, first outer air swirler 224 is shown as a substantially cylindrical component and second outer air swirler 225 and air cap 226 are shown as substantially cylindrical components that angle inward near tip 220, but these components can have other configurations as needed.

On the inner surface of first outer air swirler 224 is groove 234, which has the same functionality and can have the same configuration as groove 34 of nozzle 16, but instead is configured to retain detent fingers 236 of secondary cone 228.

Located concentrically within first outer air swirler 224 is metering set 244, which includes secondary cone 228 (also called a prefilmer), primary cone/secondary distributor 230, primary distributor 232, a downstream portion of primary fuel tube 222, and a downstream portion of secondary fuel tube 223. Immediately within first outer air swirler 224 is secondary cone 228, which is similar to prefilmer 28 of nozzle 16. Secondary cone 228 can be a substantially cylindrical component that angles inward near tip 220 and has a smaller diameter than first outer air swirler 224 at each corresponding location with respect to tip 220. Between first outer air swirler 224 and secondary cone 228 can be a gap that includes air or another gas to aid in minimizing thermal conduction between first outer air swirler 224 and secondary cone 228. As with first outer air swirler 224, secondary cone 228 can have other configurations as needed. Secondary cone 228 can be made from a variety of materials, such as a metallic material or alloy, but should be resilient enough to allow for detent fingers 236 to snap into groove 234 while minimizing the conduction of thermal energy from first outer air swirler 224 to those components concentrically within secondary cone 228.

Secondary cone 228 includes one or more detent fingers 236, which have the same functionality and can have the same configuration as detent fingers 36 of nozzle 16 or annular detent 136 of nozzle 116. Detent fingers 236 are configured to retain secondary cone 228 in place concentrically within first outer air swirler 224. Detent fingers 236 can be a number of detents spaced circumferentially around secondary cone 228, or can extend circumferentially around secondary cone 228 continuously to form a cylinder (as shown in FIG. 5). Detent fingers 236 are shown in FIG. 6 to be located at a rear end of secondary cone 228, but can be located anywhere along the outer surface of secondary cone 228 so long as detent fingers 236 are able to snap into groove 234 such that secondary cone 228 is held in place relative to first outer air swirler 224. Detent fingers 236 can have a number of shapes, such as those shown in FIGS. 4A, 4B, and 4C, or other shapes configured to snap into groove 234 and maintain concentricity. Additionally, the placement and shape of detent fingers 236 should allow for differing thermal expansions of secondary cone 228 and first outer air swirler 224 while ensuring that the two components are held together.

Like with nozzle 16, the interaction between groove 234 and detent fingers 236 of nozzle 216 is only interface contact with no other fastening means, thereby minimizing thermal conduction between first outer air swirler 224 and secondary cone 228 as compared to welds, braze, or pins, which have increased thermal conduction because the welds or pins create a direct conduction path through which thermal energy can pass by having a fastening material between the two components (instead of the indirect interface contact conduction path of the disclosed configuration).

Additionally, because detent fingers 236 snap into groove 234 to retain metering set 244 within first outer air swirler 224 when secondary cone 228 is inserted into first outer air swirler 224 so detent fingers 236 are inward of groove 234, there is no need to drill through first outer air swirler 224 during assembly so a pin or other fastener can be installed to hold secondary cone 228 in place. Because a pin or other fastener is not needed, the number of components that can cause wear due to vibration of nozzle 216 is reduced. There is also no need to weld or brze the inner surface of first outer air swirler 224 to secondary cone 228, which can be burdensome and time consuming during the assembly and quality inspection processes. In addition, because a weld, braze, or pin is not needed, there is one less connection that requires validation and possible rework if nozzle 216 (the interface between first outer air swirler 224 and secondary cone 228) is unsatisfactory. Thus, the use of groove 234 and detent fingers 236 reduces the number of parts required and the overall complexity of nozzle 216 (which, in turn, reduces cost).

Located concentrically within secondary cone 228 are a downstream portion of primary fuel tube 222, a downstream portion of secondary fuel tube 223, primary cone/secondary distributor 230, and primary distributor 232, which work together to convey fuel through nozzle 216 to tip 220 at which point the fuel mixes with air provided by first outer air swirler 224 and second outer air swirler 225 and is expelled into the combustion chamber. These inner components, including primary cone/secondary distributor 230 and primary distributor 232, can be made from a variety of materials, such as a metallic material or alloy, but should be able to handle the relatively cool temperature of the fuel and any thermal energy passing to these components through secondary cone 228 without causing the fuel to coke. Primary fuel tube 222 and secondary fuel tube 223 can be made from a variety of materials suited to handle the flow of fuel, but primary fuel tube 222 should be configured to be fluidly separate from secondary fuel tube 223 such that the flow of fuel within each tube does not mix until after the fuel of primary fuel tube 222 has flown through primary distributor 232 and the fuel of secondary fuel tube 223 has flown through a gap between primary cone/secondary distributor 230 and secondary cone 228.

All of the advantages associated with nozzle 16 are also present in nozzle 216 of FIG. 6, including the decrease in thermal conduction between first outer air swirler 224 and secondary cone 228, an increased ease of assembly and disassembly, the reduction in wear, and the ability to perform various in-process tests to nozzle 216 before nozzle 216 is completely assembled.

Discussion of Possible Embodiments

The following are non-exclusive descriptions of possible embodiments of the present invention.

A fuel injector with a nozzle, the nozzle comprising: an outer air swirler having an outer surface and an inner surface and a forward end and an aft end, the outer air swirler having a groove on the inner surface; and a prefilmer located concentrically within the outer air swirler, the prefilmer having at least one detent finger to engage the groove on the inner surface of the outer air swirler.

The nozzle of the preceding paragraph can optionally include, additionally and/or alternatively, any one or more of the following features, configurations, and/or additional components:

A fuel swirler located concentrically within the prefilmer and configured to convey fuel to a forward end of the nozzle, the fuel swirler having at least one tab extending axially at an aft end; and an inner air swirler having a cylindrical forward end located concentrically within the fuel swirler and an aft support extending radially outward to contact the outer air swirler, the cylindrical forward end contacting the at least one tab of the fuel swirler to hold the fuel swirler in place.

The at least one tab is arranged around a circumference of the fuel swirler to form a substantially cylindrical shape.

The aft support of the inner air swirler is fastened to the outer air swirler.

The aft support of the inner air swirler is welded or brazed to the outer air swirler.

The at least one detent finger is a pawl.

The at least one detent finger is arranged around the prefilmer to form a substantially cylindrical shape.

The prefilmer is made of a resilient material.

The fuel injector is configured as a pressure atomizer fuel injector.

The fuel injector is configured as an airblast style fuel injector.

The outer air swirler angles radially inward at the forward end and the prefilmer angles radially inward at a forward end such that the forward end of the prefilmer is located concentrically within the forward end of the air swirler.

A method of constructing a nozzle for a fuel injector, the method comprising: inserting a prefilmer with at least one detent finger into an outer air swirler with a groove on an inner surface; and engaging the groove in the outer air swirler with the at least one detent finger.

The method of the preceding paragraph can optionally include, additionally and/or alternatively, any one or more of the following techniques, features, configurations, and/or steps:

Inserting a fuel swirler into the prefilmer, the fuel swirler having at least one tab at an aft end that extends in an axial direction; and engaging the at least one tab of the fuel swirler with a cylindrical forward end of an inner air swirler.

Fastening an aft support of the inner air swirler to an aft end of the outer air swirler.

The aft support of the inner air swirler is fastened to the aft end of the outer air swirler by a weld.

Any relative terms or terms of degree used herein, such as "generally," "substantially," "approximately," and the like, should be interpreted in accordance with and subject to any applicable definitions or limits expressly stated herein. In all instances, any relative terms or terms of degree used herein should be interpreted to broadly encompass any relevant disclosed embodiments as well as any ranges or variations as would be understood by a person of ordinary skill in the art in view of the entirety of the present disclosure, such as to encompass ordinary manufacturing tolerance variations, incidental alignment variations, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fuel injector with a nozzle, the nozzle comprising:
   - an outer air swirler having an outer surface and an inner surface and a forward end and an aft end, the outer air swirler having a groove on the inner surface;
   - a prefilmer located concentrically within the outer air swirler, the prefilmer having at least one detent finger to engage the groove on the inner surface of the outer air swirler;
   - a fuel swirler located concentrically within the prefilmer and configured to convey fuel to a forward end of the nozzle, the fuel swirler having at least one tab extending axially at an aft end; and
   - an inner air swirler having a cylindrical forward end located concentrically within the fuel swirler and an aft support extending radially outward to contact the outer air swirler, the cylindrical forward end contacting the at least one tab of the fuel swirler to hold the fuel swirler in place and the aft support having an opening configured to allow a fuel tube to extend through to contact the fuel swirler.

2. The nozzle of claim 1, wherein the at least one tab is arranged around a circumference of the fuel swirler to form a substantially cylindrical shape.

3. The nozzle of claim 1, wherein the aft support of the inner air swirler is fastened to the outer air swirler.

4. The nozzle of claim 3, wherein the aft support of the inner air swirler is welded or brazed to the outer air swirler.

5. The nozzle of claim 1, wherein the at least one detent finger is a pawl.

6. The nozzle of claim 1, wherein the at least one detent finger is arranged around the prefilmer to form a substantially cylindrical shape.

7. The nozzle of claim 1, wherein the prefilmer is made of a resilient material.

8. The nozzle of claim 1, wherein the fuel injector is configured as a pressure atomizer fuel injector.

9. The nozzle of claim 1, wherein the fuel injector is configured as an airblast style fuel injector.

10. The nozzle of claim 1, wherein the outer air swirler angles radially inward at the forward end and the prefilmer angles radially inward at a forward end such that the forward end of the prefilmer is located concentrically within the forward end of the air swirler.

11. A method of constructing a nozzle for a fuel injector, the method comprising:

inserting a prefilmer with at least one detent finger into an outer air swirler with a groove on an inner surface;

engaging the groove in the outer air swirler with the at least one detent finger;

inserting a fuel swirler into the prefilmer, the fuel swirler having at least one tab at an aft end that extends in an axial direction;

engaging the at least one tab of the fuel swirler with a cylindrical forward end of an inner air swirler; and contacting an aft facing edge of the outer air swirler with a forward facing edge of an aft support of the inner air swirler.

12. The method of claim 11, further comprising:

fastening the forward facing edge an aft support of the inner air swirler to the aft facing edge of the aft end of the outer air swirler.

13. The method of claim 12, wherein the aft support of the inner air swirler is fastened to the aft end of the outer air swirler by a weld.

14. The nozzle of claim 1, wherein the fuel swirler includes an orifice configured to accommodate an end of the fuel tube.

15. The method of claim 11, further comprising:

inserting a fuel tube into an opening in the aft support of the inner air swirler to contact the fuel swirler.

16. A fuel injector with a nozzle with the nozzle, the nozzle comprising:

an outer air swirler having an outer surface and an inner surface and a forward end and an aft end, the outer air swirler having a groove on the inner surface;

a prefilmer located concentrically within the outer air swirler, the prefilmer having at least one detent finger to engage the groove on the inner surface of the outer air swirler;

a fuel swirler located concentrically within the prefilmer and configured to convey fuel to a forward end of the nozzle, the fuel swirler having at least one tab extending axially at an aft end; and an inner air swirler having a cylindrical forward end located concentrically within the fuel swirler and an aft support extending rearward to not be concentrically within the outer air swirler, the cylindrical forward end contacting the at least one tab of the fuel swirler to hold the fuel swirler in place and the aft support extending radially outward to contact an aft facing edge of the aft end of the outer air swirler.

17. The nozzle of claim 16, wherein the aft support of the inner air swirler includes an opening configured to allow a fuel tube to extend through to contact the fuel swirler.

18. The nozzle of claim 16, wherein a radially outer surface of the aft support of the inner air swirler is aligned with the outer surface of the outer air swirler.

19. The nozzle of claim 16, wherein the at least one tab is arranged around a circumference of the fuel swirler to form a substantially cylindrical shape.

20. The nozzle of claim 16, wherein the aft support of the inner air swirler is fastened to the aft facing edge of the aft end of the outer air swirler.

* * * * *